US007865991B2

(12) United States Patent
Lee

(10) Patent No.: US 7,865,991 B2
(45) Date of Patent: Jan. 11, 2011

(54) WASHING MACHINE AND STEAM WASHING METHOD THEREOF

(75) Inventor: Jong Chil Lee, Gyeonggi-do (KR)

(73) Assignee: Daewoo Electronics Corporation, Seoul (KR)

( * ) Notice: Subject to any disclaimer, the term of this patent is extended or adjusted under 35 U.S.C. 154(b) by 337 days.

(21) Appl. No.: 12/126,339

(22) Filed: May 23, 2008

(65) Prior Publication Data

US 2008/0289117 A1 Nov. 27, 2008

(30) Foreign Application Priority Data

May 25, 2007 (KR) ..... 10-2007-0051062
May 25, 2007 (KR) ..... 10-2007-0051063

(51) Int. Cl.
*D06F 39/04* (2006.01)

(52) U.S. Cl. ..... 8/158; 68/15

(58) Field of Classification Search ..... 8/158; 68/15

See application file for complete search history.

(56) References Cited

U.S. PATENT DOCUMENTS 2,374,247 A * 4/1945 Thaxton ..... 68/145
2,612,035 A * 9/1952 Buss et al. ..... 68/12.05
7,627,920 B2 * 12/2009 Wong et al. ..... 8/159
2003/0100101 A1 * 5/2003 Huth et al. ..... 435/264

FOREIGN PATENT DOCUMENTS

JP 07-323181 * 12/1995

* cited by examiner

*Primary Examiner*—Frankie L Stinson
(74) *Attorney, Agent, or Firm*—Occhiuti Rohlicek & Tsao LLP

(57) ABSTRACT

A washing machine and steam washing method thereof are disclosed. The method includes performing primary steam washing by supplying steam to laundry, performing a washing cycle by supplying wash water to the laundry, performing a rinsing cycle, performing a spin-dry cycle to remove the wash water from the laundry, and performing secondary steam washing by supplying steam to the laundry. The washing machine has improved sterilizing effects by sterilizing bacteria and fungi with hot steam.

5 Claims, 4 Drawing Sheets

WASHING MACHINE AND STEAM WASHING METHOD THEREOF

BACKGROUND OF THE INVENTION

1. Field of the Invention

The present invention relates to a washing machine, and more particularly to a washing machine and steam washing method thereof that washes laundry with steam generated by heating wash water with a wash heater.

2. Description of the Related Art

Generally, a washing machine includes a cabinet, a tub adapted to contain wash water, a drum disposed inside the tub, a drive motor adapted to drive the drum, a water supply valve connected to the tub to supply wash water to the tub, and a detergent container connected to the water supply valve and containing detergent. Additionally, the washing machine includes a drain unit extending from the tub to the outside of the cabinet, a steam generator disposed between the water supply valve and the detergent container, and a steam heater provided to the steam generator to generate steam by heating wash water.

The washing machine performs steam washing as follows.

First, water is supplied into the steam generator and heated by the steam heater provided to the steam generator to supply steam into the drum where laundry has been received. While steam is generated by the steam heater, the drive motor rotates the drum in the forward and reverse directions to agitate the laundry inside the drum for steam washing. During the steam washing, the steam generated by means of the steam heater sterilizes bacteria and fungi in the laundry. During a washing cycle after completion of the steam washing operation, a wash heater can be operated to heat wash water inside the tub or the steam heater can be operated to supply steam into the tub.

However, the washing method of the conventional washing machine entails substantial power consumption since the steam heater is continuously operated from start to end of the washing operation to supply steam to the laundry. Moreover, in the conventional washing machine, since washing and rinsing cycles are carried out after the steam washing, bacteria or fungi can be attached to the laundry during the washing and rinsing cycles, thereby deteriorating sterilizing effects of the steam washing.

SUMMARY OF THE INVENTION

The present invention is conceived to solve the problems of the conventional techniques as described above, and an aspect of the present invention is to provide a washing machine and steam washing method thereof that supply steam to laundry to perform steam washing after completion of a spin-dry cycle.

In accordance with one aspect of the present invention, there is provided a steam washing method of a washing machine including: performing primary steam washing by supplying steam to laundry; performing a washing cycle by supplying wash water to the laundry; performing a rinsing cycle; performing a spin-dry cycle to remove the wash water from the laundry; and performing secondary steam washing by supplying steam to the laundry. Preferably, the performing of the primary and secondary steam washing comprises supplying wash water for steam, and generating the steam while alternately rotating a drum in forward and reverse directions by operating a wash heater and a motor. Preferably, when supplying the wash water for steam, the wash water for steam is supplied through an assistant water supply tube so as to prevent the wash water for steam from being absorbed by the laundry.

In accordance with another aspect of the present invention, there is provided a steam washing method of a washing machine including: performing primary steam washing by supplying steam to laundry; performing a washing cycle by supplying wash water to the laundry; performing an initial rinsing cycle; performing secondary steam washing by supplying steam to the laundry; performing a final rinsing cycle; and performing a spin-dry cycle to remove the wash water from the laundry. Preferably, the performing of the primary and secondary steam washing comprises supplying wash water for steam, and generating the steam while driving a drum by operating a wash heater and a motor.

In accordance with a further aspect of the present invention, there is provided a washing machine including: a water supply tube supplying wash water to a tub; a heater compartment to contain the wash water; a wash heater heating the wash water contained in the heater compartment to generate steam; and a level detection sensor detecting a level of the wash water contained in the heater compartment. The washing machine may further include a gasket disposed at one side of the tub; a drum disposed inside the tub to receive laundry; and an assistant water supply tube passing through the gasket to prevent wash water for steam from being supplied to the laundry. Preferably, the assistant water supply tube communicates with the water supply tube. Preferably, the washing machine further includes a water supply valve between the assistant water supply tube and the water supply tube. Preferably, the heater compartment extends outwardly from the tub.

BRIEF DESCRIPTION OF THE DRAWINGS

The above and other objects, features and advantages of the present invention will become apparent from the following description of exemplary embodiments given in conjunction with the accompanying drawings, in which.

DETAILED DESCRIPTION OF THE INVENTION

Exemplary embodiments of the present invention will be described in detail with reference to the accompanying drawings. Herein, terms should be defined in consideration of functions of components of the present invention and thus can be changed according to the custom or intention of users or operators. Therefore, definition of such terms should be determined according to overall disclosures set forth herein.

Figure 1:
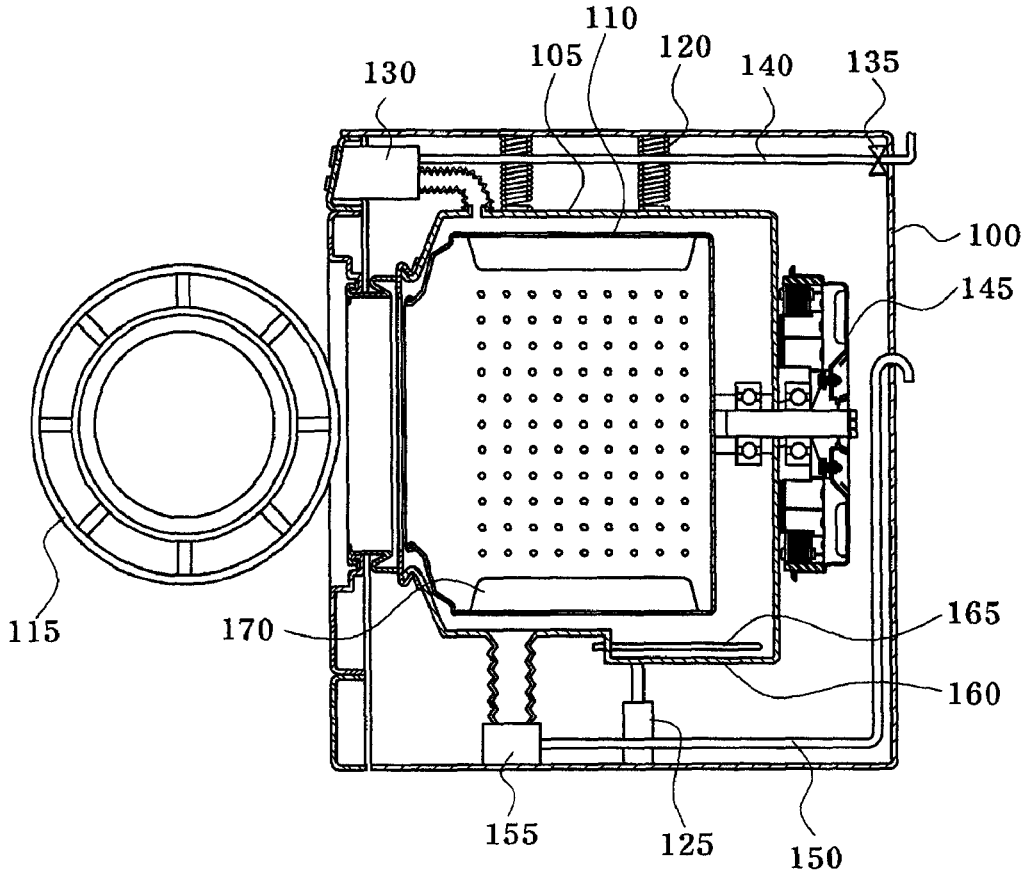
FIG. 1 is a cross-sectional view of a washing machine according to one embodiment of the present invention.
Figure 2:
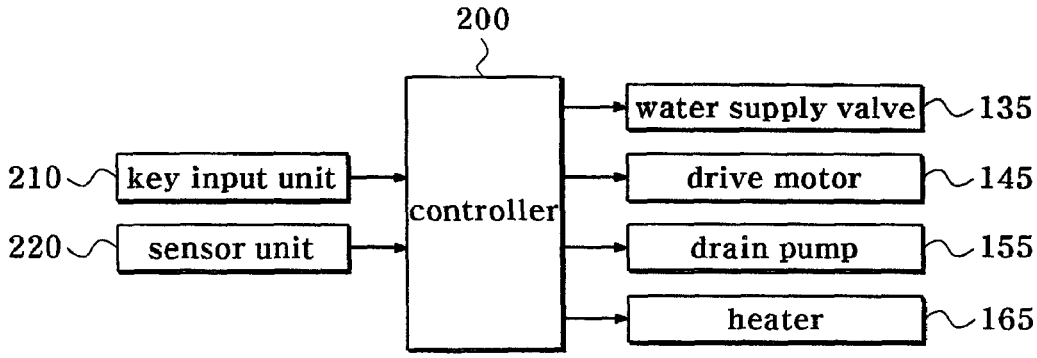
FIG. 2 is a block diagram of the washing machine according to the embodiment of the present invention.

FIG. 1 is a cross-sectional view of a washing machine according to one embodiment of the present invention, and FIG. 2 is a block diagram of the washing machine according to the embodiment of the present invention.

Referring to FIGS. 1 and 2, the washing machine includes a cabinet 100 constituting the appearance of the washing machine, a tub 105 disposed inside the cabinet 100 to contain wash water, and a drum 110 rotatably disposed inside the tub 105.

The cabinet 100 has a door 115 mounted to the front side thereof to open or close an opening of the cabinet 100 through which laundry is put into the drum, and the tub 105 is provided on upper and lower sides thereof with a support spring 120 and a damper 125 to hold the tub 105 in a buffering manner. The upper side of the tub 105 is provided with a detergent supply part 130 for supplying detergent into the tub and a water supply tube 140 which has a water supply valve 135 and supplies wash water into the tub 105.

A gasket 142 is provided with an assistant water supply tube 143. The assistant water supply tube 143 passes through the gasket 142 interposed between the cabinet 100 and the tub 105 to supply wash water for steam to a preset steam level, and is connected to the water supply valve 135 to supply the wash water for steam into a heater compartment 160 so as to prevent the wash water for steam from being absorbed by the laundry.

The tub 105 is provided at the rear side with a drive motor 145 adapted to drive the drum 110, and on the bottom with a drain path 150 and a drain pump 155 through which wash water is discharged to the outside. The heater compartment 160 is defined at a lower part of the tub 105 to contain the wash water and is provided with a wash heater 165 therein to heat the wash water when generating steam. A plurality of lifts 170 are provided on the inner surface of the drum 110.

The washing machine includes a controller 200 to control a steam washing process. For control of the washing machine, the controller 200 is electrically connected to the water supply valve 135 for supplying wash water into the tub 105, to the drive motor 145 for alternately rotating the drum in the forward and reverse directions to agitate laundry received in the drum, to the drain pump 155 for discharging the wash water to the outside of the cabinet 100, and to the wash heater 165 for heating wash water for steam.

Further, the washing machine includes a key input unit 210 for sending a key input signal to the controller 200 and a level detection sensor 220 for detecting a level of wash water inside the tub 105 when the wash water is supplied into the tub 105.

Figure 3:
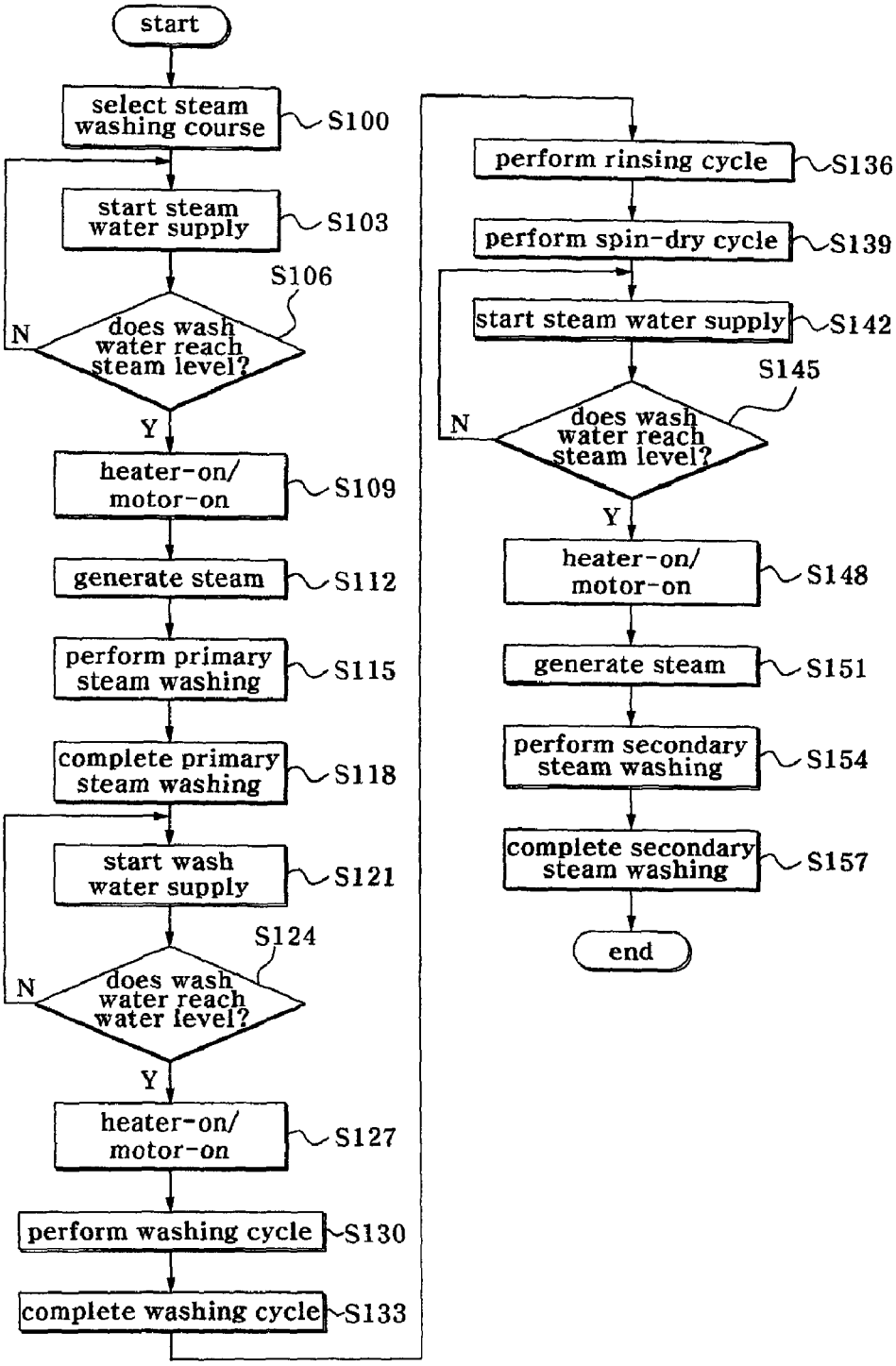
FIG. 3 is a flowchart of a steam washing method of a washing machine according to one embodiment of the present invention.

Hereinafter, a steam washing method of the washing machine according to one embodiment of the present invention will be described with reference to FIG. 3.

First, in S100, when a steam washing course is selected on the key input unit 210 with laundry put into the drum 110 of the washing machine, the controller 200 outputs a control signal to open the water supply valve 135. Then, wash water for steam is supplied into the tub 105 until it reaches a preset steam level for performing the steam washing course, in S103.

When the level detection sensor 220 detects that wash water for steam reaches the preset steam level inside the heater compartment 160 at the lower part of the tub 105 in S106, the controller 200 closes the water supply valve 135 and operates the drive motor 145 to drive the drum 110, thereby agitating the laundry in the drum 110. Here, the drum 110 may be alternately rotated in the forward and reverse directions to enhance efficiency of the steam washing course.

Then, the wash heater 165 is operated to heat the wash water to a preset temperature and generate steam in S109-S112, and primary steam washing is performed in S115. In the steam washing course, wash water is intermittently supplied through the water supply valve 135 to efficiently generate steam while the wash heater 165 heats the wash water to generate steam. Hot steam generated by means of the wash heater 165 is used to sterilize bacteria and fungi in laundry. Further, since a window of the door 115 is fogged by steam generated during the steam washing course, it is possible to visually confirm the steam washing course.

After completion of the primary steam washing in S115, the controller 200 opens the water supply valve 135 and starts wash water supply into the tub 105 along with detergent contained in the detergent supply unit 130 in S121. When the level detection sensor 220 detects that wash water reaches a preset water level, the controller 200 closes the water supply valve 135 to stop the wash water supply in S124.

Next, in S127 and S130, a washing cycle is performed by heating the wash water to a preset temperature with the wash heater 165 while agitating the laundry in the drum 110 by operating the drive motor 145 to alternately rotate the drum 110 in the forward and reverse directions. After completion of the washing cycle, the controller 200 stops the wash heater 165 and the drive motor 145 in S133.

Then, a rinsing cycle is performed to remove detergent remnants in S136. The rinsing cycle is performed once or more by supplying wash water into the tub 105 through the water supply valve 135. Here, the drive motor 145 is operated to alternately rotate the drum 110 in the forward and reverse directions in response to a control signal from the controller 200, thereby agitating the laundry in the drum 110.

After completion of the rinsing cycle, a spin-dry cycle is performed by operating the drive motor 145 to rotate the drum 110 in S139, followed by secondary steam washing.

For the secondary steam washing, the water supply valve 135 is opened and steam water supply is started to supply wash water for steam into the tub 105 up to a preset steam level in S142. At this time, the wash water for steam is supplied through the assistant water supply tube 143 so as to prevent the wash water removed from the laundry by a spin-dry cycle from being absorbed by the laundry. When the level detection sensor 220 detects that the wash water reaches the preset steam level in S145, the controller 200 closes the water supply valve 135 and operates the drive motor 145 to rotate the drum 110, thereby agitating the laundry received in the drum 110. Here, the drum 110 may be alternately rotated in the forward and reverse directions.

Then, in the steam washing method of the embodiment, the wash heater 165 is operated to heat the wash water to a preset temperature and generate steam in S148-S151, and the secondary steam washing is performed in S154. During the secondary steam washing, wash water is intermittently supplied through the water supply valve 135 or the assistant water supply valve 143 to maintain the steam level and efficiently generate steam while the wash heater 165 heats the wash water to generate the steam. After completion of the secondary steam washing of S157, the washing process is completed.

In the steam washing method of the washing machine according to the embodiment, steam washing is performed again after completion of the spin-dry cycle, thereby improving sterilization effect of the steam washing course by sterilizing bacteria attached to the laundry during the washing and rinsing cycles. Further, in the steam washing method of this embodiment, steam is generated by means of the wash heater without using a separate steam heater, so that steam is not generated during the washing cycle, thereby reducing power consumption.

Next, a steam washing method of the washing machine according to anther embodiment of the present invention will be described with reference to FIG. 4. For convenience of description, illustration and description of the same or similar components as those of the above embodiment will be omitted herein.

Figure 4:
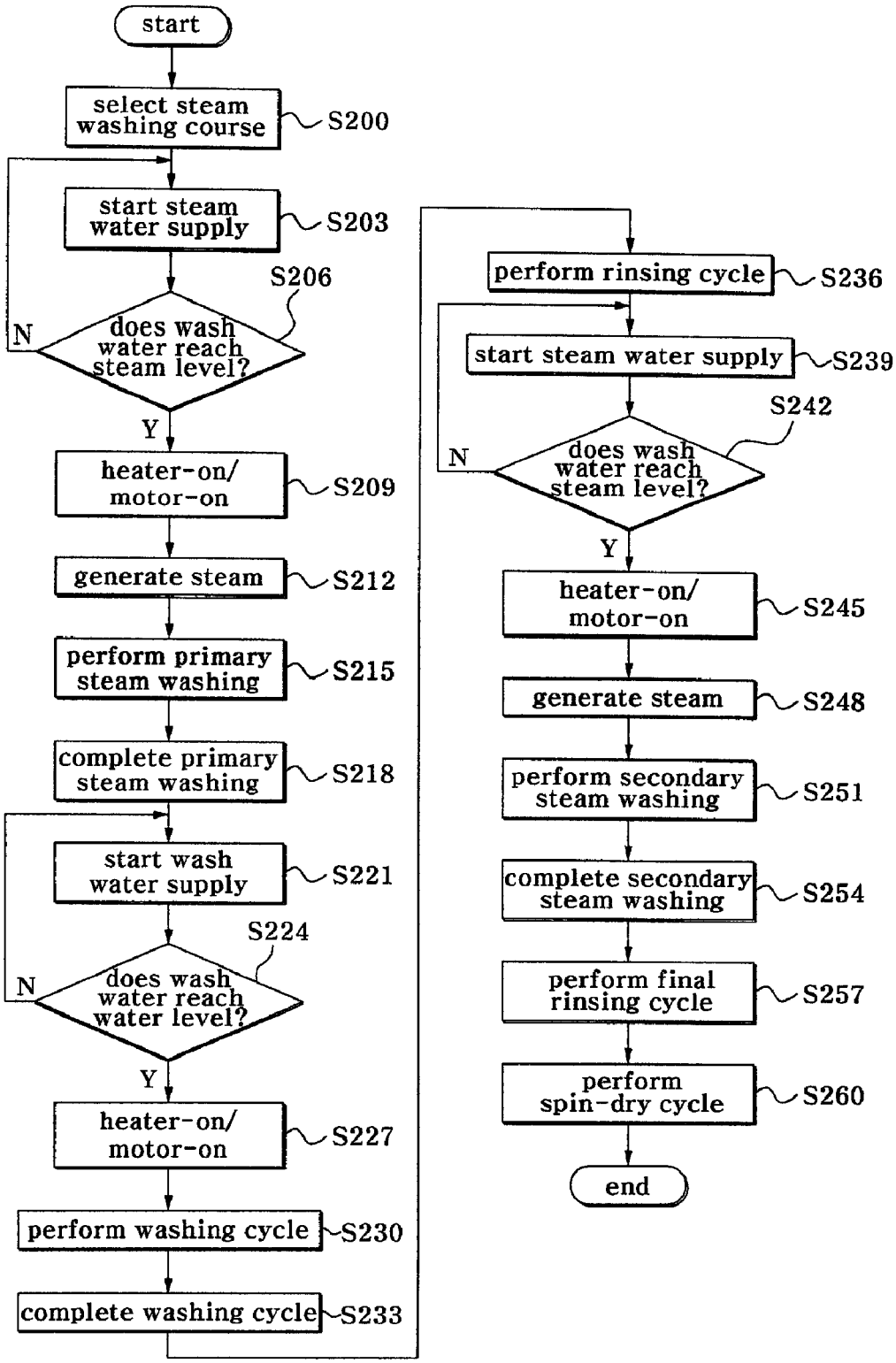
FIG. 4 is a flowchart of a steam washing method of a washing machine according to another embodiment of the present invention.

FIG. 4 is a flowchart of a steam washing method of a washing machine according to another embodiment of the present invention.

Referring to FIGS. 1, 2 and 4, when a steam washing course is selected on the key input unit 210 with laundry received in the drum 110 of the washing machine in S200, the controller 200 outputs a control signal to open the water supply valve 135. Then, wash water for steam is supplied into the tub 105 until it reaches a preset steam level for performing the steam washing course, in S203.

When the level detection sensor 220 detects that the wash water reaches the preset steam level inside the heater compartment 160 defined at the lower part of the tub 105 in S206, the controller 200 closes the water supply valve 135 and operates the drive motor 145 to drive the drum 110, thereby agitating the laundry in the drum 110. Here, the drum 110 may be alternately rotated in the forward and reverse directions to enhance efficiency of washing operation.

Then, the wash heater 165 is operated to heat the wash water to a preset temperature and generate steam in S209-S212, and primary steam washing is performed in S215. In the steam washing course, wash water is intermittently supplied through the water supply valve 135 to efficiently generate steam while the wash heater 165 heats the wash water to generate the steam.

After completion of the primary steam washing in S215, the controller 200 opens the water supply valve 135 and starts wash water supply into the tub 105 along with detergent contained in the detergent supply part 130 in S221. When the level detection sensor 220 detects that wash water reaches a preset wash water level, the controller 200 closes the water supply valve 135 to stop the wash water supply in S224.

Next, in S227 and S230, a washing cycle is performed by heating the wash water to a preset temperature with the wash heater 165 while agitating the laundry in the drum 110 by operating the drive motor 145 to alternately rotate the drum 110 in the forward and reverse directions. After completion of the washing cycle, the controller 200 stops the wash heater 165 and the drive motor 145 in S233.

Then, a rinsing cycle is performed in S236. The rinsing cycle is performed by supplying wash water into the tub 105 through the water supply valve 135 and then alternately rotating the drum 110 in the forward and reverse directions to agitate the laundry in the drum 110 by the drive motor 145 in response to a control signal from the controller 200. The rinsing cycle is performed once or more, and the last rinsing cycle will be referred to as a final rinsing cycle.

Here, secondary steam washing is performed before the final rinsing cycle, that is, between the rinsing cycles. After completion of the secondary steam washing, the final rinsing cycle is performed, thereby completing the rinsing cycle.

For the secondary steam washing, the water supply valve 135 is opened and steam water supply is started to supply wash water for steam into the tub 105 up to a preset steam level in S239. When the level detection sensor 220 detects that the wash water reaches the preset steam level in S242, the controller 200 closes the water supply valve 135 and operates the drive motor 145 to rotate the drum 110, thereby agitating the laundry in the drum 110. Here, the drum 110 may be alternately rotated in the forward and reverse directions.

Then, in the steam washing method of this embodiment, the wash heater 165 is operated to heat wash water to a preset temperature and generate steam in S245-S248, and the secondary steam washing is performed in S251. During the secondary steam washing, wash water is intermittently supplied through the water supply valve 135 or the assistant water supply valve 135 to maintain the steam level and efficiently generate steam while the wash heater 165 heats the wash water to generate the steam. After completion of the secondary steam washing of S254, the final rinsing cycle is performed in S257. Since the final rinsing cycle is performed after steam washing, it is possible to prevent effects of fabric softeners and the like used in the rinsing cycle from being reduced due to the steam washing. After completion of all rinsing cycles, a spin-dry cycle is performed in S260, thereby completing the washing process.

In the steam washing method of this embodiment, steam washing is performed again between the washing cycle and the final rinsing cycle, improving sterilization effect of the steam washing operation by sterilizing bacteria attached to laundry during the washing and rinsing cycles. Further, in the steam washing method of this embodiment, steam is generated by means of a wash heater without using a separate steam heater so that steam is not generated during the washing cycle, thereby reducing power consumption.

The washing machine and steam washing method thereof according to the present invention have various advantageous effects.

For example, hot steam is generated using a wash heater to perform steam sterilization of bacteria and fungi in laundry.

Additionally, since steam washing is performed again after a spin-dry cycle, bacteria and fungi attached to laundry during washing and rinsing cycles can be sterilized, thereby improving sterilization effects.

Further, since steam washing is performed again after the washing and rinsing cycles, bacteria and fungi attached to laundry during the washing and rinsing cycles can be sterilized, thereby improving the sterilization effects.

Further, since a glass window of a door is fogged by steam generated during the steam washing, it is possible to visually confirm the steam washing process.

Moreover, since steam is generated by the wash heater without using a separate steam heater, the washing machine can perform a washing cycle without generating steam, thereby reducing power consumption.

Although the present invention has been described with reference to the embodiments and the accompanying drawings, the embodiments and drawings are given by way of illustration only, and, it will be apparent to those skilled in the art that various modifications and equivalent embodiments can be made without departing from the scope of the present invention. Therefore, the scope of the present invention should be limited only by the accompanying claims.

What is claimed is:

1. A steam washing method of a washing machine, comprising:

performing primary steam washing by supplying steam to laundry;

performing a washing cycle by supplying wash water to the laundry;

performing a rinsing cycle;

performing a spin-dry cycle to remove the wash water from the laundry; and performing secondary steam washing by supplying steam to the laundry.

2. The method according to claim 1, wherein the performing of the primary and secondary steam washing comprises supplying wash water for steam, and generating the steam while alternately rotating a drum in forward and reverse directions by operating a wash heater and a motor.

3. The method according to claim 2, wherein, when supplying the wash water for steam, the wash water for steam is supplied through an assistant water supply tube so as to prevent the wash water for steam from being absorbed by the laundry.

4. A steam washing method of a washing machine, comprising:

performing primary steam washing by supplying steam to laundry;

performing a washing cycle by supplying wash water to the laundry;

performing an initial rinsing cycle;

performing secondary steam washing by supplying steam to the laundry;

performing a final rinsing cycle; and performing a spin-dry cycle to remove the wash water from the laundry.

5. The method according to claim 4, wherein the performing of the primary and secondary steam washing comprises supplying wash water for steam, and generating the steam while driving a drum by operating a wash heater and a motor.

* * * * *